United States Patent [19]

Yavetz

[11] Patent Number: 4,938,483

[45] Date of Patent: Jul. 3, 1990

[54] MULTI-VEHICLE INTERACTIVE TOY SYSTEM

[75] Inventor: Ido Yavetz, Providence, R.I.

[73] Assignee: M. H. Segan & Company, Inc., New York, N.Y.

[21] Appl. No.: 117,191

[22] Filed: Nov. 4, 1987

[51] Int. Cl.[5] ..... A63H 30/04

[52] U.S. Cl. ..... 273/311; 273/312; 273/85 R; 273/86 B; 273/1 E; 340/825.72; 446/175; 446/454; 446/456

[58] Field of Search ..... 273/310–312, 273/86 B, 1 E; 446/175, 454, 456, 435; 340/825.72, 696; 901/1, 8; 364/410; 434/22, 29

[56] References Cited

U.S. PATENT DOCUMENTS

| | | | |
|---|---|---|---|
| 3,400,488 | 9/1968 | Phillpott et al. | 46/244 |
| 3,482,046 | 12/1969 | Hughson et al. | 179/15 |
| 3,639,755 | 2/1972 | Wrege | 246/187 B |
| 3,782,031 | 1/1974 | Byron | 46/244 R |
| 4,080,602 | 3/1978 | Hattori et al. | 343/225 |
| 4,171,468 | 10/1979 | Reiner | 179/15 |
| 4,334,221 | 6/1982 | Rosenhagen et al. | 340/825.72 |
| 4,545,583 | 10/1985 | Pearman et al. | 434/22 |

FOREIGN PATENT DOCUMENTS

| | | | |
|---|---|---|---|
| 2119267 | 11/1983 | United Kingdom | 446/456 |

*Primary Examiner*—Edward M. Coven
*Assistant Examiner*—Jessica J. Harrison
*Attorney, Agent, or Firm*—Schechter, Brucker & Pavane

[57] ABSTRACT

A multi-vehicle interactive combat type game is disclosed. The game includes first and second controllers each of which communicates with at least one vehicle. Each controller is capable of selectively generating control signals comprising at least a first command signal and a movement command signal and for conveying the control signal to the vehicle controlled thereby. Each vehicle includes a receiver for receiving the control signals, a transmitter for transmitting an electromagnetic signal in a substantially straight line path when the fire command signal is present, a motor for moving the vehicle when the movement command signal is present, a sensor for detecting impingement of an electromagnetic signal fired by another vehicle, and an indicator for providing an indication that the sensor has detected the impingement of the electromagnetic signal.

44 Claims, 13 Drawing Sheets

MULTI-VEHICLE INTERACTIVE TOY SYSTEM

BACKGROUND OF THE INVENTION

1. Field of the Invention This invention pertains to electrically powered vehicles and more particularly to interactive electrically powered toy vehicles.

2. Prior Art

Electrically powered toy vehicles are well known in the prior art. Typically, such vehicles incorporate a power.supply, e.g. a battery, a motor driving a wheel pair, and a steering mechanism. Vehicle direction and speed are determined by proper control of the motor and steering mechanism. These controls may be on the vehicle itself or, in more advanced designs, on a remote controller which communicates control signals to the vehicle via wireless rf transmission.

U.S. Pat. No. 4,334,221 teaches a controller capable of remotely controlling a plurality of vehicles and discloses an approach for avoiding interference between one controller and another. As described in that patent, each controller repetitively transmits low duty-cycle command bursts containing an identity code and steering and speed commands for the controlled vehicle. The controllers transmit their command bursts asynchronously. Accordingly, due to the low duty-cycle of the transmissions, a high probability exists for non-interference even when several controllers are simultaneously operated with each controlling several vehicles. Each vehicle attempts to match any incoming command burst with a standard including an identity code unique to that vehicle. If a command burst is correct in every respect, including its identity code, the steering and speed commands therein are stored in the vehicle and executed until a new correct burst is received. Command bursts which are not correct in every respect are ignored whereupon the previously stored commands are executed.

While this arrangement is effective for controlling the movement of a plurality of vehicles, there is no interaction between the vehicles, and it is anticipated that the ability to control the movement of a plurality of vehicles with a single controller will prove insufficient to maintain interest in the product. At best, the vehicles can be raced, but it is difficult to preceive how a single controller can effectively race a plurality of vehicles when the controller can only address a single vehicle at a time.

SUMMARY OF THE INVENTION

The present invention is a multi-vehicle toy system requiring continuous interaction between the vehicles and hence the players controlling them. More particularly, the invention is a combat type multi-vehicle game comprising first and second controllers, each including means operable by a player for selectively generating control signals including at least a fire command signal and a movement command signal; means for conveying the control signals; and at least first and second vehicles controlled by the first and second controllers, respectively, each vehicle including detecting means for receiving the control signals, firing means responsive to the fire command signal and for transmitting an electromagnetic signal in a substantially straight line path when the fire command signal is present, motive means for moving the vehicle when the movement command signal is present, sensor mean for detecting the impingement of a electromagnetic signal fired by another vehicle and for generating a damage signal in response thereto, an indicator means responsive to the damage signal for providing an indication that the sensor means has detected an electromagnetic signal fired by another vehicle.

Further features and advantages of the combat game in accordance with the present invention will be more fully apparent from the following detailed description and annexed drawings of the presently preferred embodiment thereof.

BRIEF DESCRIPTION OF THE DRAWINGS

In the drawings, wherein like numerals represent like parts.

DETAILED DESCRIPTION OF THE PREFERRED EMBODIMENTS

Figure 1:
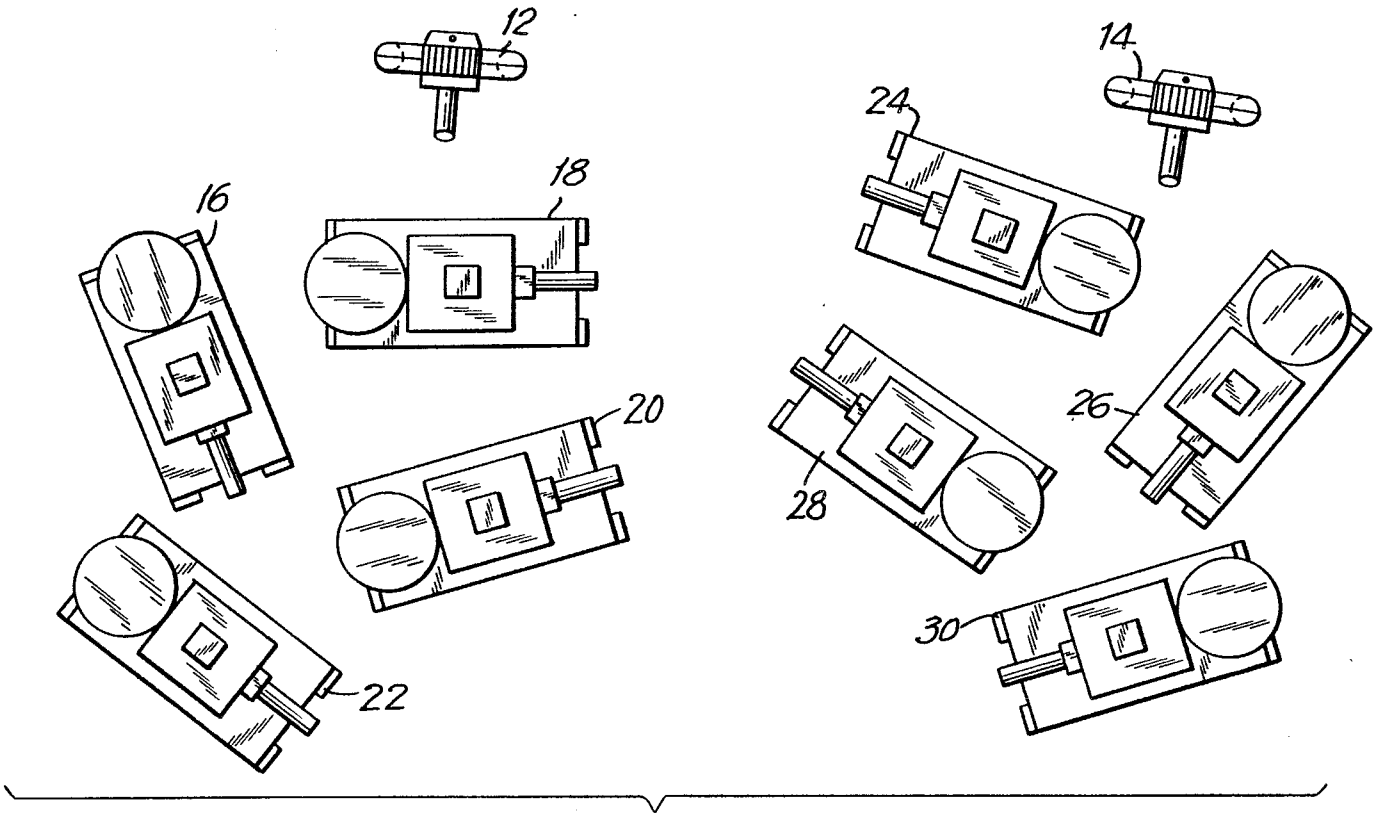
FIG. 1 is a diagrammatic representation of an interactive multi-vehicle toy system in accordance with the present invention.

Referring now to the drawings, and initially to FIG. 1, a multi-vehicle interactive toy system is shown to comprise first and second "joystick" type controllers 12 and 14, respectively, and a plurality of combat type toy vehicles, shown as tanks 16, 18, 20, 22, 24, 26, 28 and 30. As will be explained in greater detail below, controller 12 controls the operation of the vehicles 16, 18, 20 and 22 and controller 14 controls the operation of the vehicles 24, 26, 28 and 30. Each controller 12, 14 communicates with its respective group of tanks by rf remote control, also as will be more fully explained below.

Figure 2:
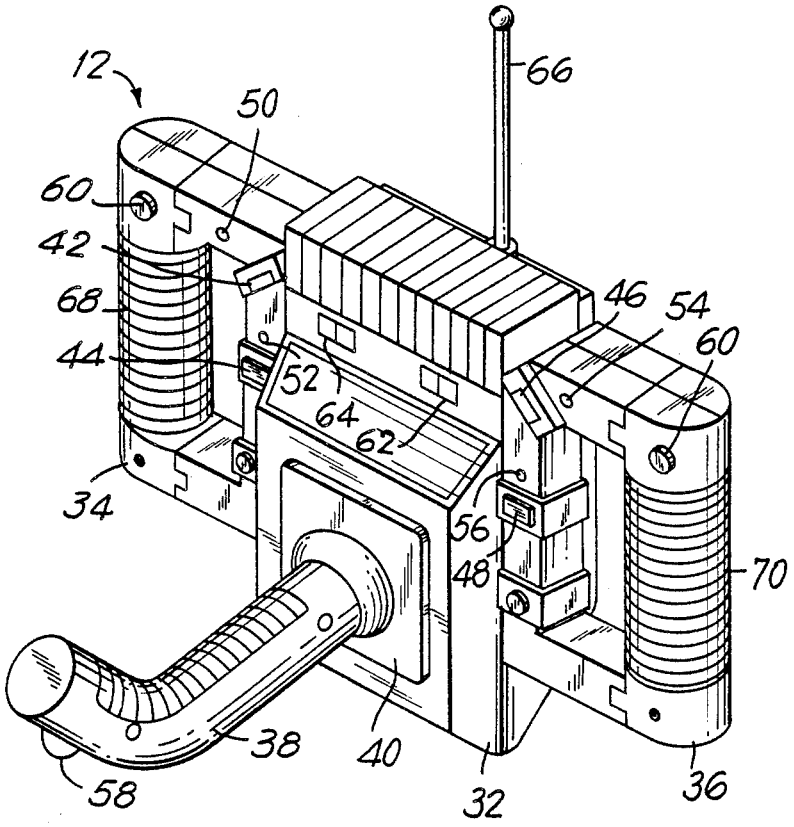
FIG. 2 is a perspective view of a joystick-type controller in accordance with the invention.

As the construction and operation of the controllers 12 and 14 is identical, a description of one will suffice for both. Accordingly, a description of the controller 12 will now be given with reference to FIGS. 2–4. Referring initially to FIG. 2, controller 12 comprises a housing 32 having a pair of handles 34, 36 on either side thereof to accommodate both right and left handed players. In a conventional manner, a lever or joystick 38 extends from the housing 32 through a flexible member 40, the joystick 38 being movable by a player for providing specific commands to the tanks 16, 18, 20 and 22 as will be more fully described below. As also shown in FIG. 2, the controller 12 incorporates four pushbutton switches 42, 44, 46 and 48, two in each handle 34, 36, for selecting the particular vehicle 16, 18, 20 or 22 to be controlled by the controller 12 at any given time. Four LED's 50, 52, 54 and 56, one associated with each of the pushbutton switches 42, 44, 46 and 48, are also incorporated in the handles 34, 36 for providing a visual indication of the vehicle 16, 18, 20 or 22 currently being controlled by the controller 12. A momentary pushbutton switch 58 is incorporated in the joystick 38 for providing a "fire" signal to the controlled vehicle and an additional pair of pushbutton switches 60, one in each handle 34, 36, serve to activate and deactivate a shield in the controlled vehicle for blocking shots fired by enemy vehicles, all as will be more fully explained below. The switches 60 are ganged together such that depression of either serves to activate and deactivate the shield, the shield being activated upon the initial depression of either switch 60 and deactivated upon subsequent depression thereof. A two position ON/-OFF switch 62 incorporated in the housing 32 activates and deactivates the controller 12, and a second two position switch 64 also incorporated in the housing 32 selects the frequency for transmitting command signals from the controller 12 to the controlled vehicle. Protruding from one end of the housing 32 is an antenna 66 from which command signals are transmitted from the controller 12 to the controlled vehicle. The ribbed handle grips 68, 70 facilitate gripping of the controller 12 and also enhance the styling thereof. As is conventional in the art, the joystick 38 is movable to a plurality of positions for selectively closing switch contacts incorporated in the housing 32 beneath the flexible member 40 for generating digital logic signals indicative of specific commands for the controlled vehicle. In addition to its centered or neutral position, the joystick 38 in the preferred controller 12 is movable toward the antenna 66 to one of three forward positions for moving the controlled vehicle forward at progressively faster speeds, away from the antenna 66 to one of three reverse positions for moving the controlled vehicle in reverse at progressively faster speeds, a left position for turning the controlled vehicle to the left and a right position for turning the controlled vehicle to the right. If the joystick is simultaneously moved to a forward or reverse position and a left or right position, the vehicle will respond by turning in the indicated direction. For example, if the joystick is moved to the third forward position and to the left, the vehicle will make a fast, tight left turn. Similarly, if the joystick is simultaneously moved to the third reverse position and to the right, the controlled vehicle will make a fast, tight right turn in reverse. If the joystick 38 is moved to the left or right without simultaneously moving the joystick to one of the forward or reverse positions, the controlled vehicle will turn in place to the left or right, respectively.

Figure 3:
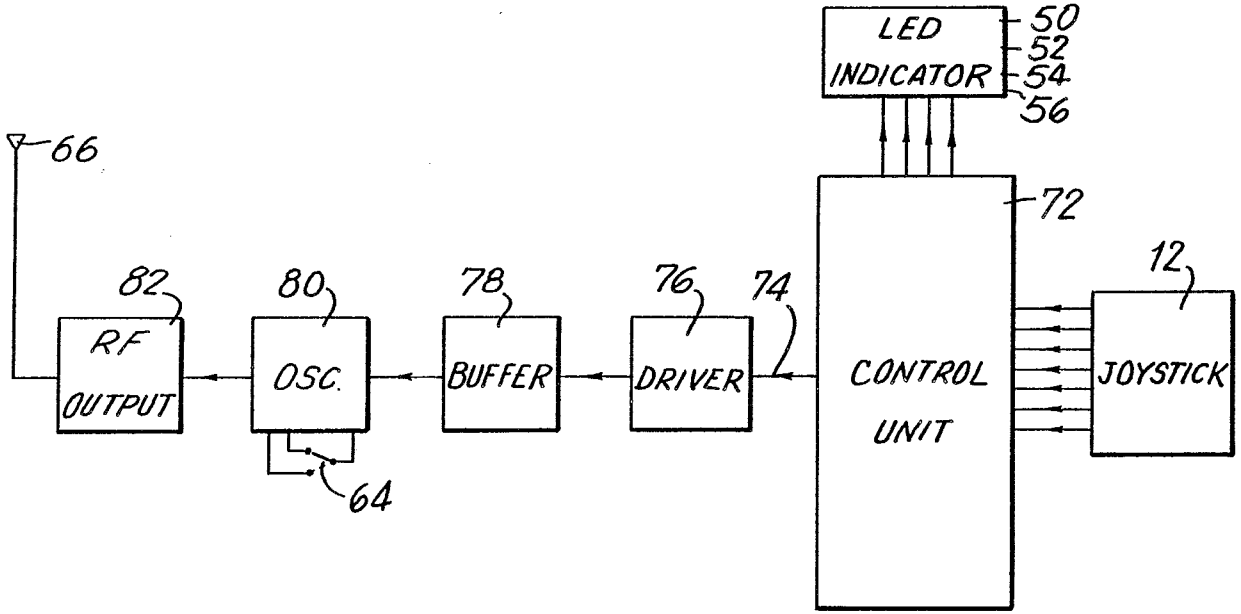
FIG. 3 is a block diagram of a circuit for the controller of FIG. 2.
Figure 5:
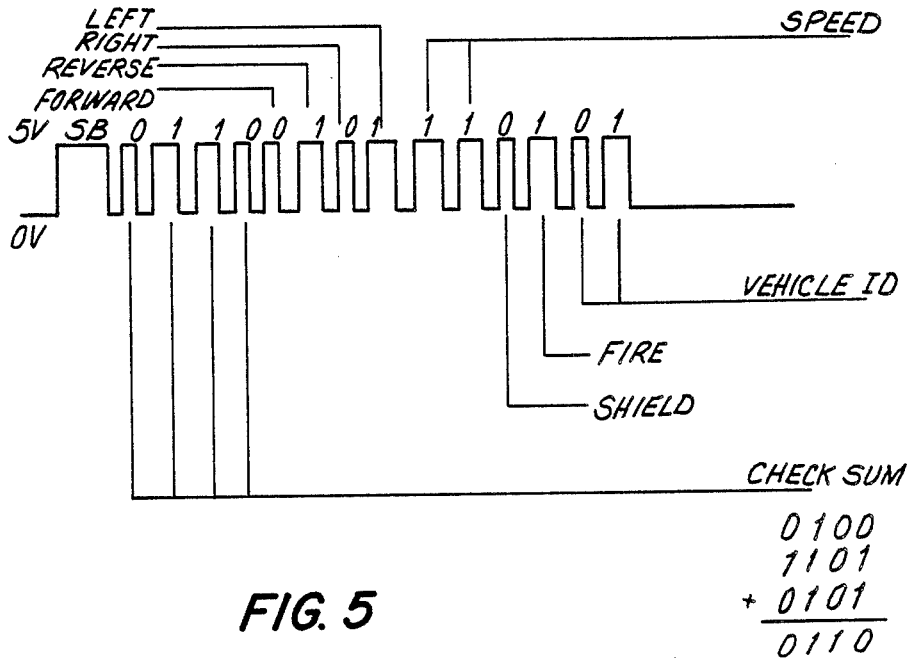
FIG. 5 shows a single data burst from the controller of FIG. 2.

FIG. 3 shows, in block diagram form, the circuitry incorporated in the controller 12 for generating the command signals and transmitting same to the controlled vehicle. As diagramatically illustrated in FIG. 3, and in accordance with the preferred embodiment of the invention, the outputs from the various switches in the controller 12, i.e. vehicle select switches 42, 44, 46 and 48, fire button 58, shield switches 60, ON/OFF switch 62 and the switches (not shown) indicating the position of joystick 38, are applied to a microprocessor 72 disposed inside the housing 32. Provided the ON/-OFF switch 62 is in the ON position, the microprocessor senses the position of the various switches and, in response thereto, produces a pulse width modulated data stream at the output line 74 containing as information command signals for the controlled vehicle as directed by the controller 12. By way of example FIG. 5 shows a typical data output from the microprocessor 70 at the line 74. As shown, the output comprises a start bit for cueing the receiver situated in the controlled vehicle, followed by a four bit check sum which is verified at the receiver in a well known manner. The check sum is followed by four data bits successively indicating which, if any, of the forward, reverse, right and left command signals has been activated by the positioning of the joystick 38. Assuming that a "0" data bit indicates the absence of a command signal and a "1" data bit the presence of the signal, FIG. 5 shows that the joystick has been positioned for commanding the toy vehicle to move in reverse and to the left.

The next two bits in the data stream indicate the vehicle speed commanded by the joystick 38. As indicated above, the joystick 38 is movable from a centered position in which vehicle motion is stopped, to one of three speed positions for commanding the vehicle to move at progressively faster speeds. As will be readily appreciated by those of ordinary skill in the art, these four command signals, i.e. stop, slow speed, medium speed and high speed, require two data bits. The significance of these two data bits in the preferred embodiment is shown below:

| Speed Data Bits | Speed |
|---|---|
| 00 | Stop |
| 01 | Slow Speed |
| 10 | Medium Speed |
| 11 | High Speed |

The next data bit indicates whether the shield on the controlled vehicle has been activated by depressing one of the pushbuttons 60 and the following data bit indicates whether the pushbutton 58 in the joystick 38 has been depressed for providing a "fire" command to the controlled vehicle. In the preferred embodiment, a "1" data bit indicates that the shield status is being changed from its previous state and a "0" data bit indicates that the shield status is to be left as is. Likewise, a "0" data bit indicates that the fire command signal has not been given, and a "1" data bit indicates that it has. Accordingly, in the example shown in FIG. 5, the data indicates that the vehicle shield is to be left a is and that the fire command signal has been given.

The last two data bits indicate which of the four vehicles 16, 18, 20 or 22 is being controlled by the controller 12 as selected by depression of one of the pushbutton switches 42, 44, 46 or 48. Again, as will be apparent to those skilled in the art, two data bits are required to discern among the possible vehicles. For example, the final two data bits may indicate the controlled vehicle as follows:

| Vehicle ID Bits | Controlled Vehicle |
|---|---|
| 00 | Tank 16 |
| 01 | Tank 18 |
| 10 | Tank 20 |

-continued

| Vehicle ID Bits | Controlled Vehicle |
|---|---|
| 11 | Tank 22 |

In the preferred embodiment, the duration of the start bit is approximately 8 milliseconds, the duration of a "1" data bit is approximately 4 milliseconds, and the duration of a "0" data bit is approximately 2 milliseconds.

Figure 6:
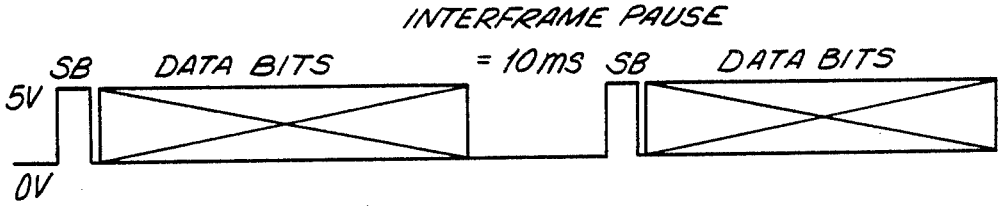
FIG. 6 shows successive data bursts from the controller of FIG. 2.

As long as the controller 12 remains ON, the microprocessor 72 continuously outputs data via the output line 74. This is illustrated in FIG. 6, where it can be seen that a pause of approximately 10 milliseconds separates each data burst from the microprocessor. During this pause, the microprocessor reassesses its various inputs such that each data burst indicates the then current status of the command signals from the controller 12.

Referring back to FIG. 3, the data transmitted via the output line 74 is applied to a driver circuit 76 and from there to a buffer or isolation amplifier 78. The output of the buffer 78 is applied to an oscillator circuit 80 where the output from an rf oscillator is modulated by the data signal at the output of the buffer 78. Actually, the oscillator circuit 80 incorporates two crystals operating at different frequencies, one of which is selected by the frequency select switch 64. Preferably, both oscillators are in the 27 MHz range, for example, one may oscillate at 27045 kHz and the other at 27095 kHz. As will be more fully explained below, the utilization of dual rf oscillators and frequency select switch 64 avoids cross talk between the controllers 12 and 14. Still referring to FIG. 3, the modulated output signal from the oscillator circuit 80 is input to an rf output circuit 82, the output of which is applied to the antenna 66 for transmission of the modulated rf signal to the controlled vehicle. As also shown in FIG. 3, the microprocessor 72 provides another output signal for selectively activating one of the LED's 50, 52, 54 or 56 for indicating which vehicle 16, 18, 20 or 22 has been selected for control by the controller 12. Like the microprocessor 72, the circuits for the driver 76, buffer 78, oscillating circuit 80 and rf output circuit 82 are disposed within the controller housing 32.

Figure 4:
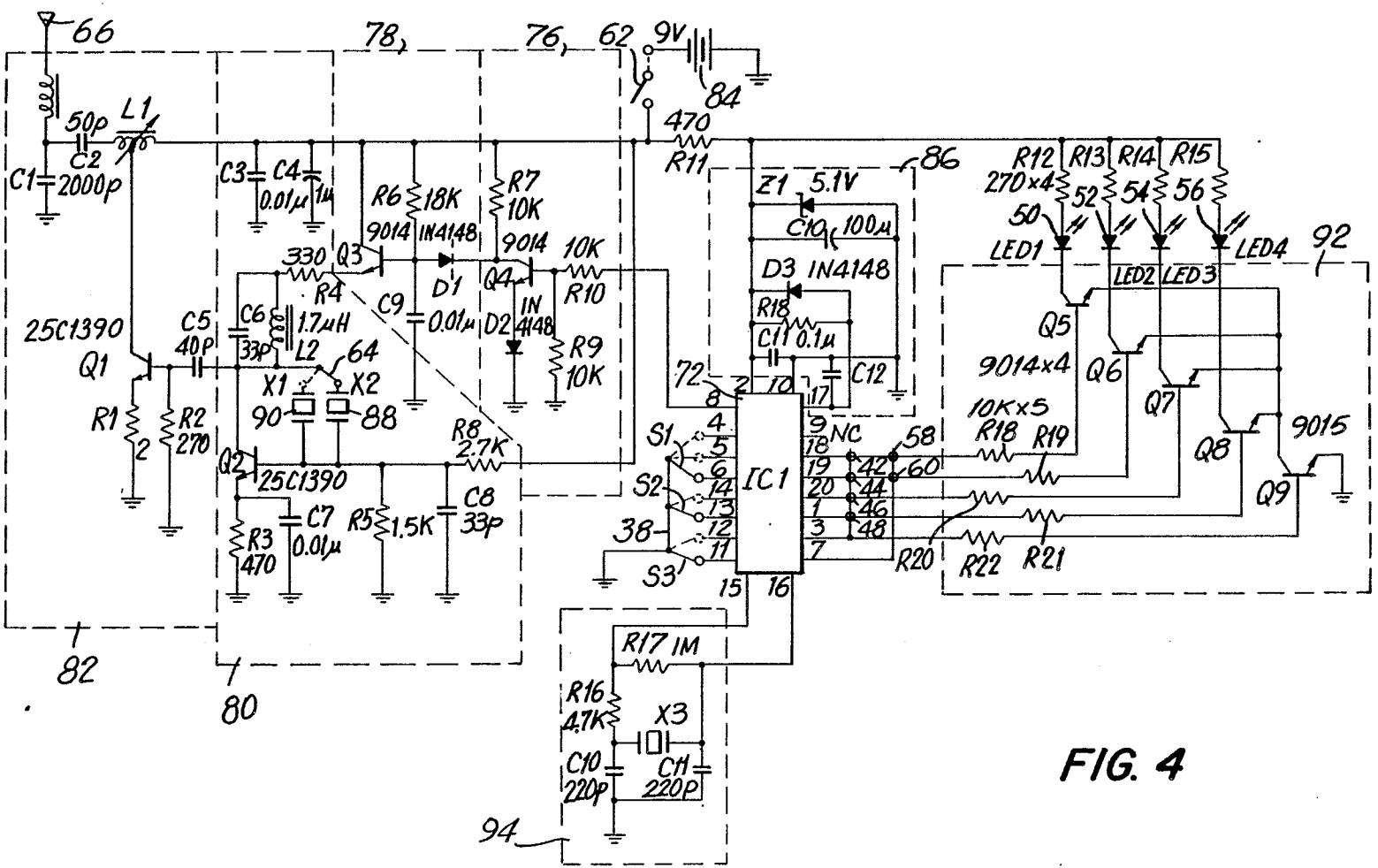
FIG. 4 is a circuit schematic for the controller of FIG. 2.

FIG. 4 illustrates a preferred circuit diagram for the controller 12, though persons skilled in the art who have read this description will recognize that other circuit designs are possible. In FIG. 4, dotted lines delineate the circuit blocks, e.g. driver 76, buffer 78, etc., diagramatically illustrated in FIG. 3. However, it should be recognized that the delineation is somewhat arbitrary, and that certain circuit components could as readily be considered part of one subcircuit as another. For example, the 40 pf capacitor in the rf output circuit 82 could as readily be considered part of the oscillator circuit 80.

As shown in FIG. 4, the circuitry for the controller 12 is powered by a nine volt DC power supply, preferably comprising a battery 84, which powers the controller when the ON/OFF switch 62 is in the ON position. The battery 84 is disposed within the housing 32 behind a removable panel (not shown) for accommodating battery replacement as necessary. The subcircuit 86 regulates the DC voltage supplied to the microprocessor 72 and also resets the microprocessor when the switch 62 is closed. After reset, the microprocessor 72 "reads" the inputs from the vehicle ID switches 42, 44, 46 and 48, the pushbutton "fire" switch 58, the pushbutton shield switches 60 and the switch contacts of the joystick 38. In FIG. 4, the switches controlled by positioning of the joystick 38 are designated as S1, S2 and S3, S1 indicating the speed command signal, S2 indicating the right and left turn command signals and S3 indicating the forward and reverse command signals. The microprocessor 72 produces a data output stream in accordance with FIGS. 5 and 6 to the output line 74 as long as the controller 12 remains activated by leaving switch 62 in the ON position. As described above, during the pause between data bursts from the microprocessor 72 (FIG. 6), the microprocessor rescans its various inputs such that the next data burst indicates the then current status of the various command signals as directed by the player operating the controller 12.

As shown in FIG. 4, and as previously described with respect to FIG. 3, the data signal from the line 74 is input to a driver 76 and from there to a buffer applifier 78. As also indicted above, the output of the buffer 78 is input to the rf oscillator circuit 80 which incorporates the frequency select switch 64 for selecting one of two oscillators 88, 90, each of which oscillates at a different frequency. The selected rf frequency is modulated in a conventional manner in the circuit 80 by the data signal output from the buffer 78. The modulated output signal from the circuit 80 is then input to the rf output circuit 82, the output of which is applied to the antenna 66 for wireless transmission of the modulated signal to the controlled vehicle. Also shown in FIG. 4 is an LED driver circuit 92 for activating one of the four LED's 50, 52, 54 or 56 depending on which of the vehicle ID buttons, 42, 44, 46 or 48, is selected at any given time. The subcircuit 94 generates clock pulses for the microprocessor 72. A parts list for the circuit illustrated in FIG. 4 appears below.

PARTS LIST

| | | | | | |
|---|---|---|---|---|---|
| R1 | 2 | R17 | 1M | C6 | 33pf |
| R2 | 270 | R18 | 10K | C7 | .01uf |
| R3 | 470 | R19 | 10K | C8 | 33pf |
| R4 | 330 | R20 | 10K | C9 | .01uf |
| R5 | 1.5K | R21 | 10K | C10 | 100uf |
| R6 | 18K | R22 | 10K | C11 | .1uf |
| R7 | 10K | X1 | 27045kHz | C12 | .47uf |
| R8 | 2.7K | X2 | 27095kHz | Q1 | 25C1390 |
| R9 | 10K | X3 | 495kHz | Q2 | 25C1390 |
| R10 | 10K | IC1 | COP413 | Q3 | 9014 |
| R11 | 470 | D1–D3 | IN 4148 | Q4 | 9014 |
| R12 | 270 | C1 | 2000pf | Q5 | 9014 |
| R13 | 270 | C2 | 50pf | Q6 | 9014 |
| R14 | 270 | C3 | 0.01uf | Q7 | 9014 |
| R15 | 270 | C4 | 1uf | Q8 | 9014 |
| R16 | 4.7K | C5 | 40pf | Q9 | 9015 |

As indicated above, the microprocessor 72 is programmed to produce an output data signal over the line 74 based on the various inputs to the microprocessor as selected by the operator of the controller 12. Based on the foregoing description, a suitable program for operating the microprocessor in this manner will be easily apparent to persons of ordinary skill in the art.

Having described the construction and operation of the controllers 12 and 14, the construction and operation of the controlled vehicles, shown in the drawings as tanks, will now be described. As each of the tanks 16, 18, 20, 22, 24, 26, 28 and is substantially identical, only the toy tank 16 will be described.

Figure 7:
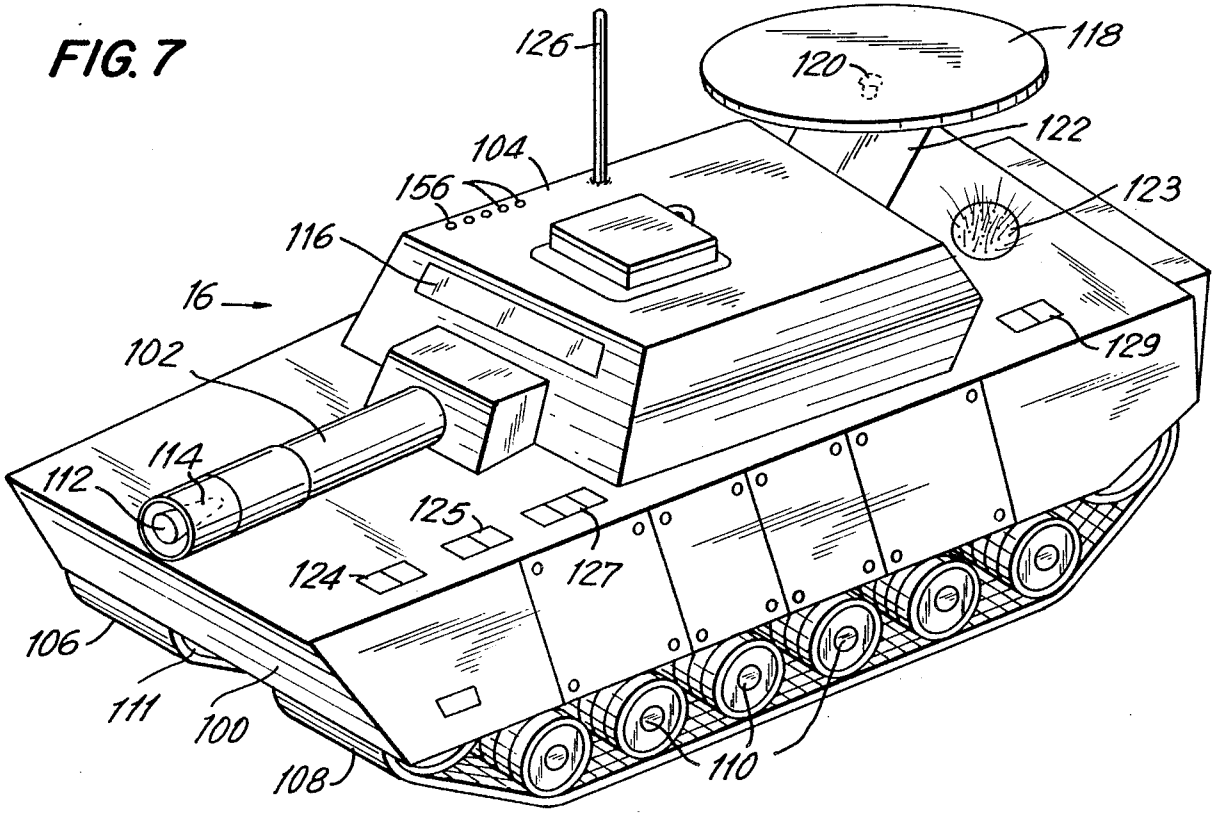
FIG. 7 is a perspective view of a toy vehicle in accordance with the present invention.
Figure 8:
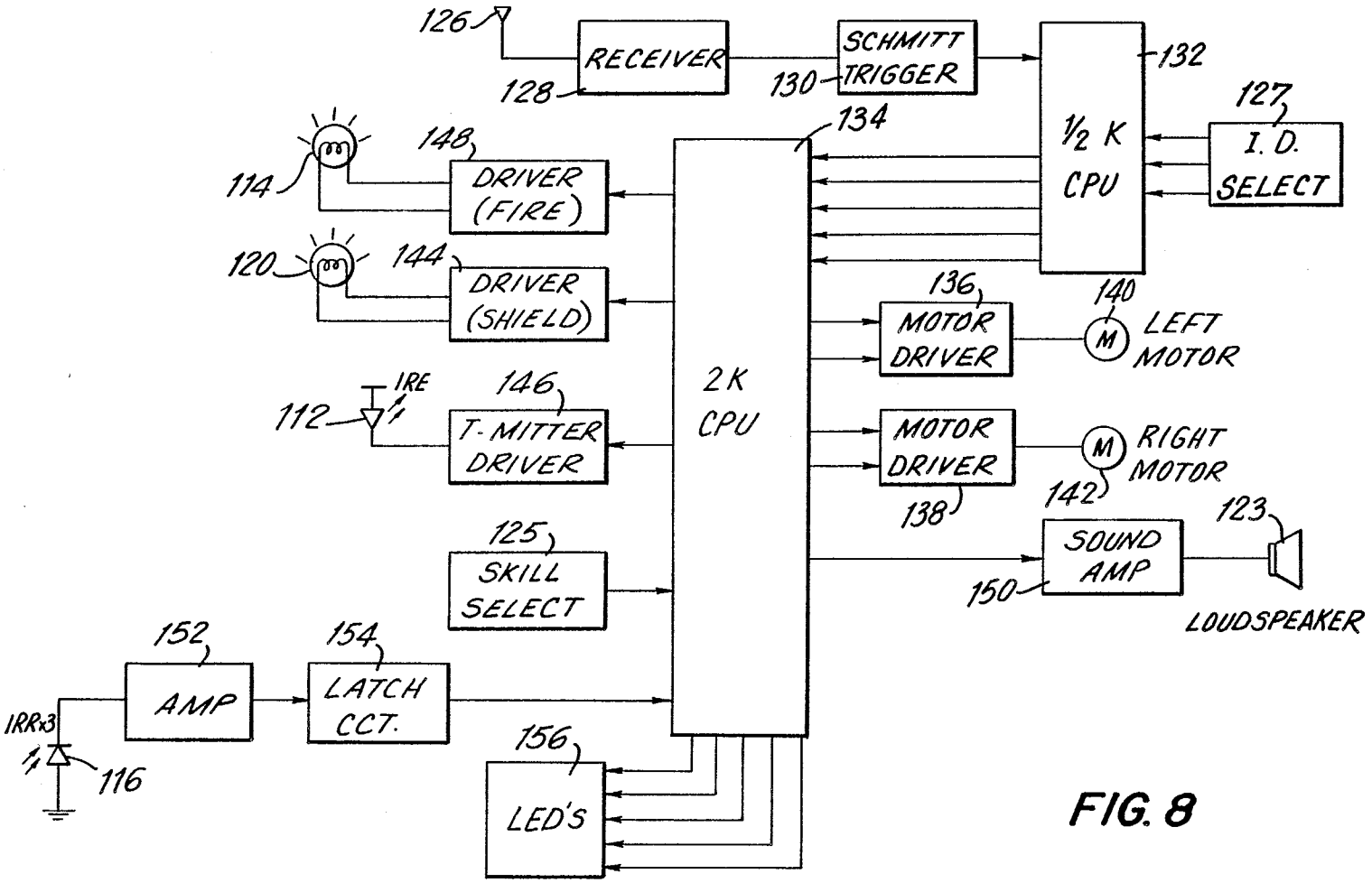
FIG. 8 is a block diagram of a circuit for the toy vehicle of FIG. 7.
Figure 9:
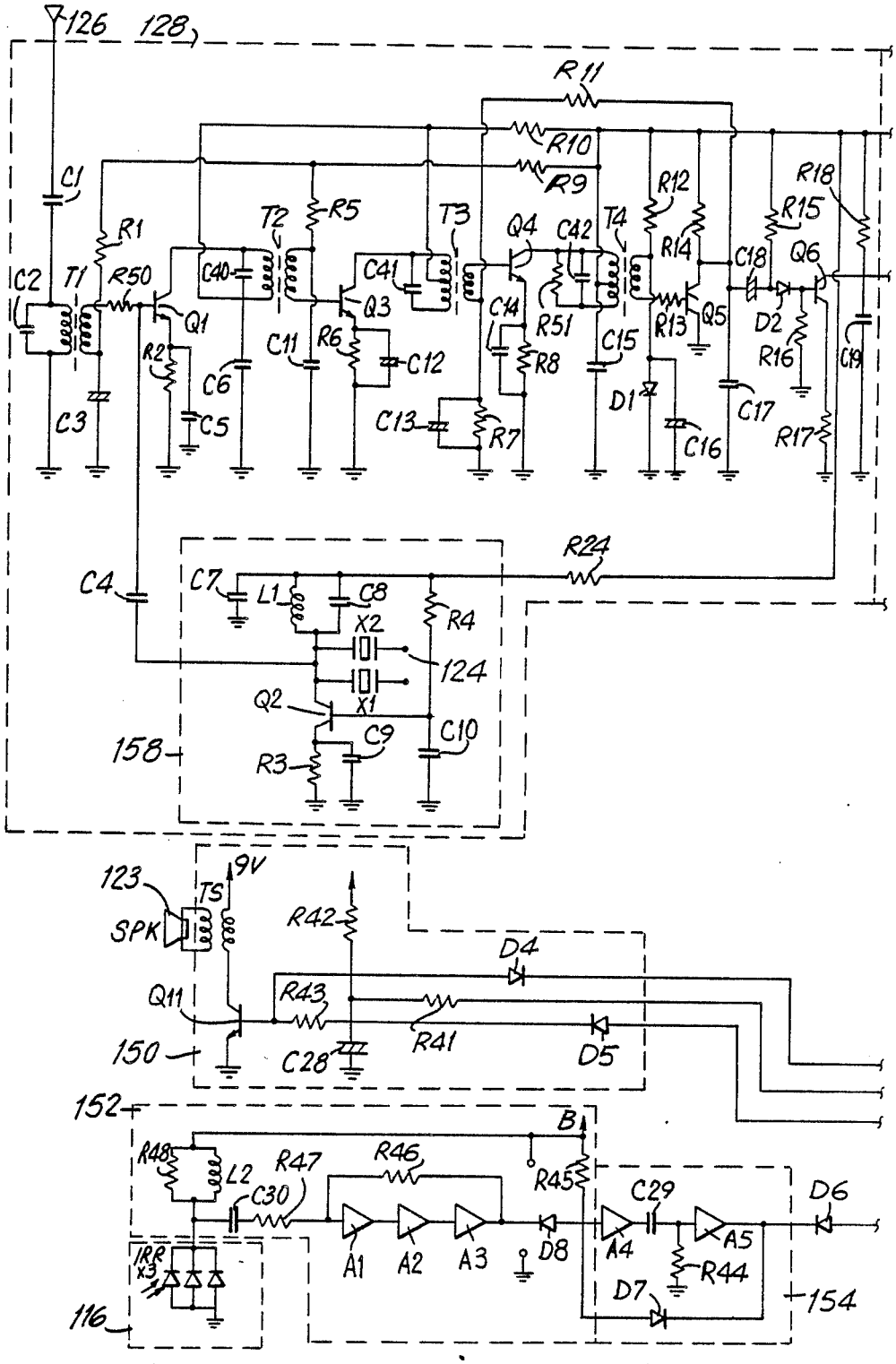
FIG. 9 is a circuit schematic for the toy vehicle of FIG. 7.
Figure 9:
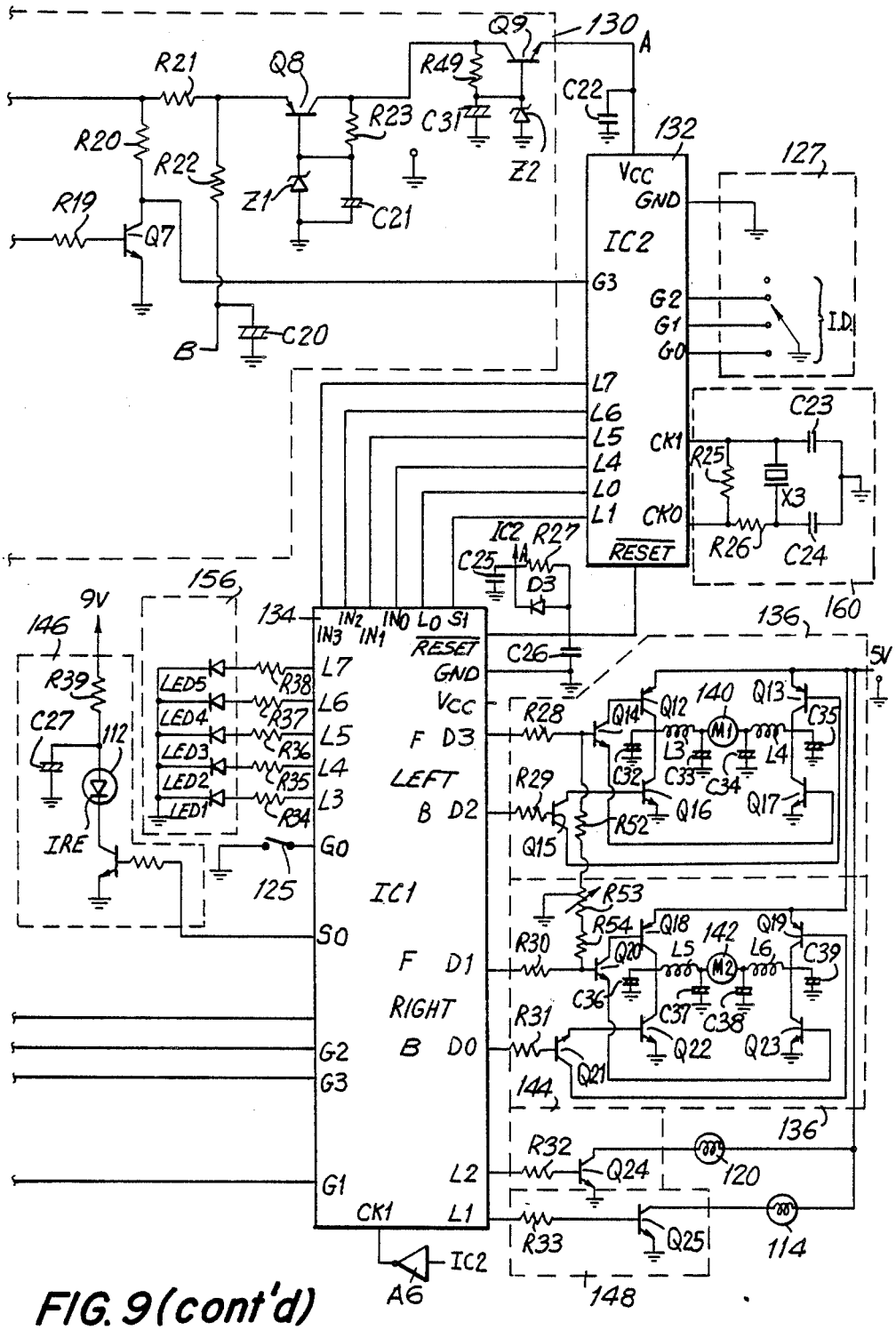
Figure 10A:
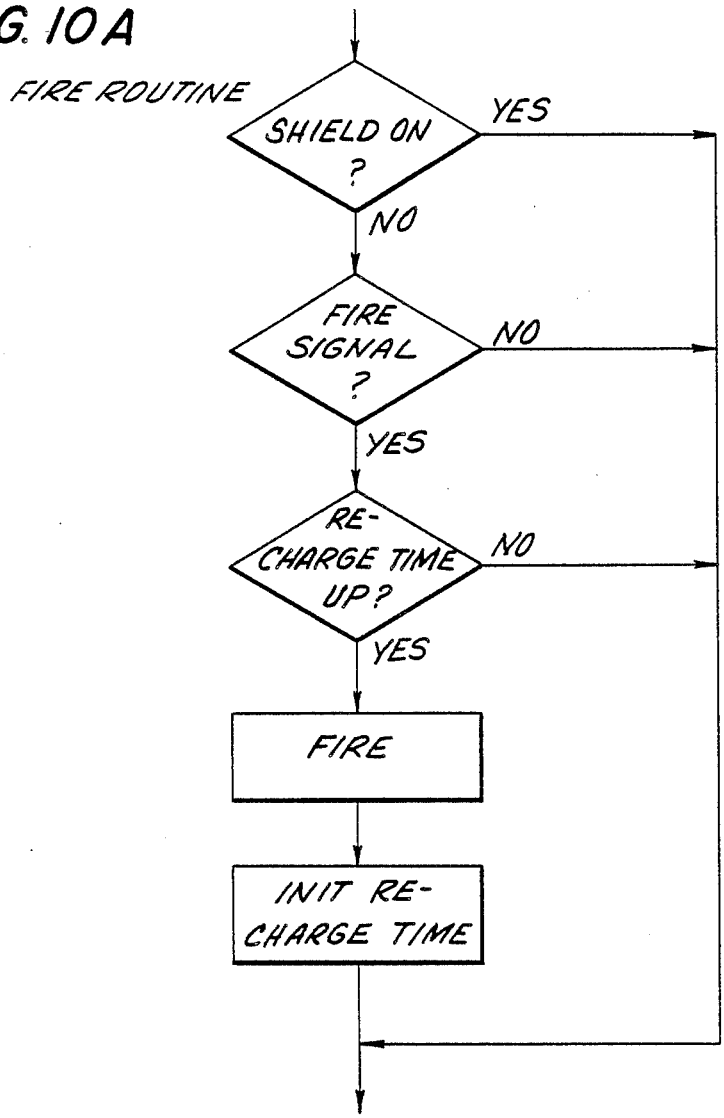
FIG. 10A is a flow chart for the "fire" routine of the microprocessor incorporated in the circuit of FIG. 9.
Figure 10B:
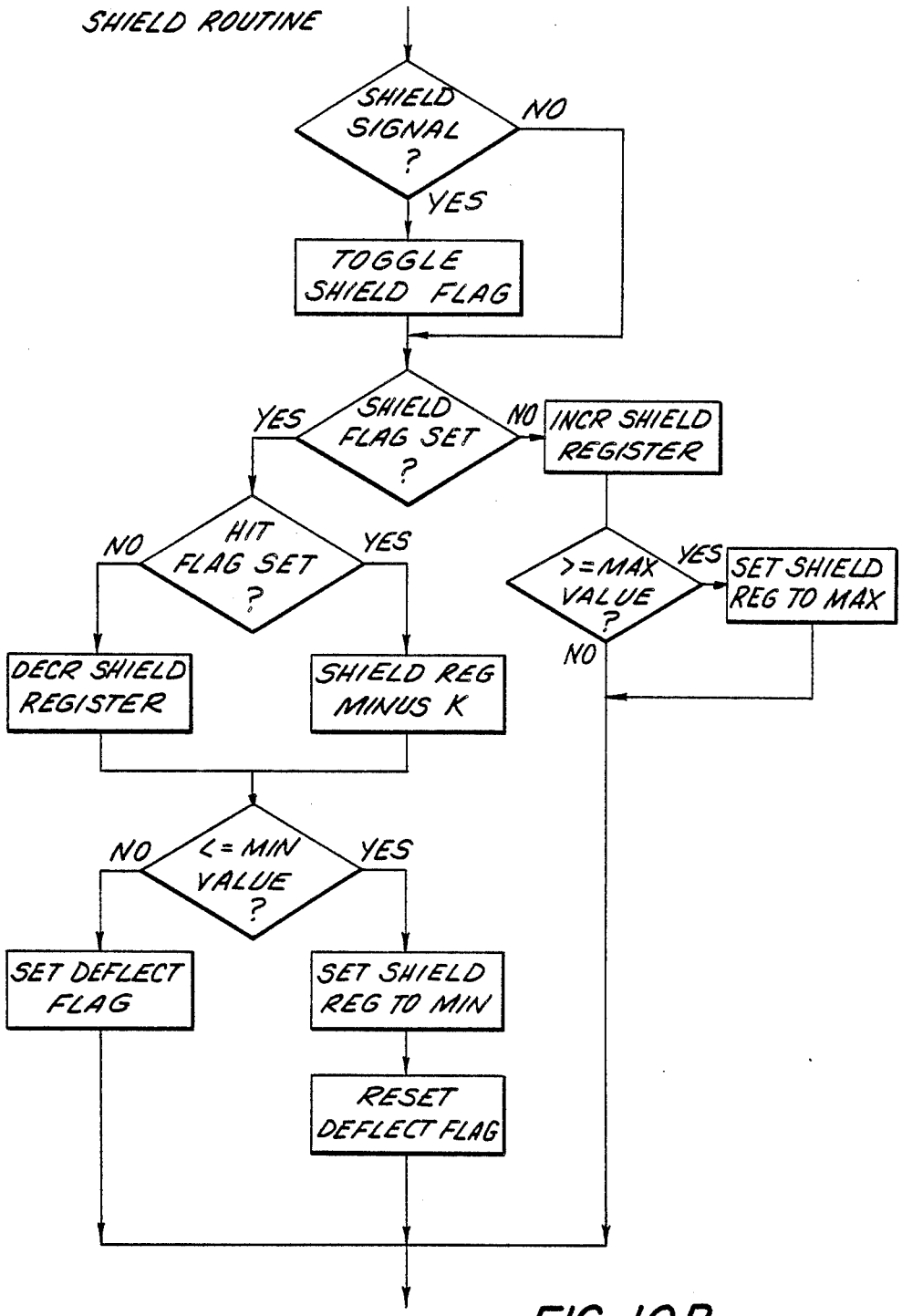
FIG. 10B is a flow chart for the "shield" routine for the microprocessor incorporated in the circuit of FIG. 9.
Figure 10C:
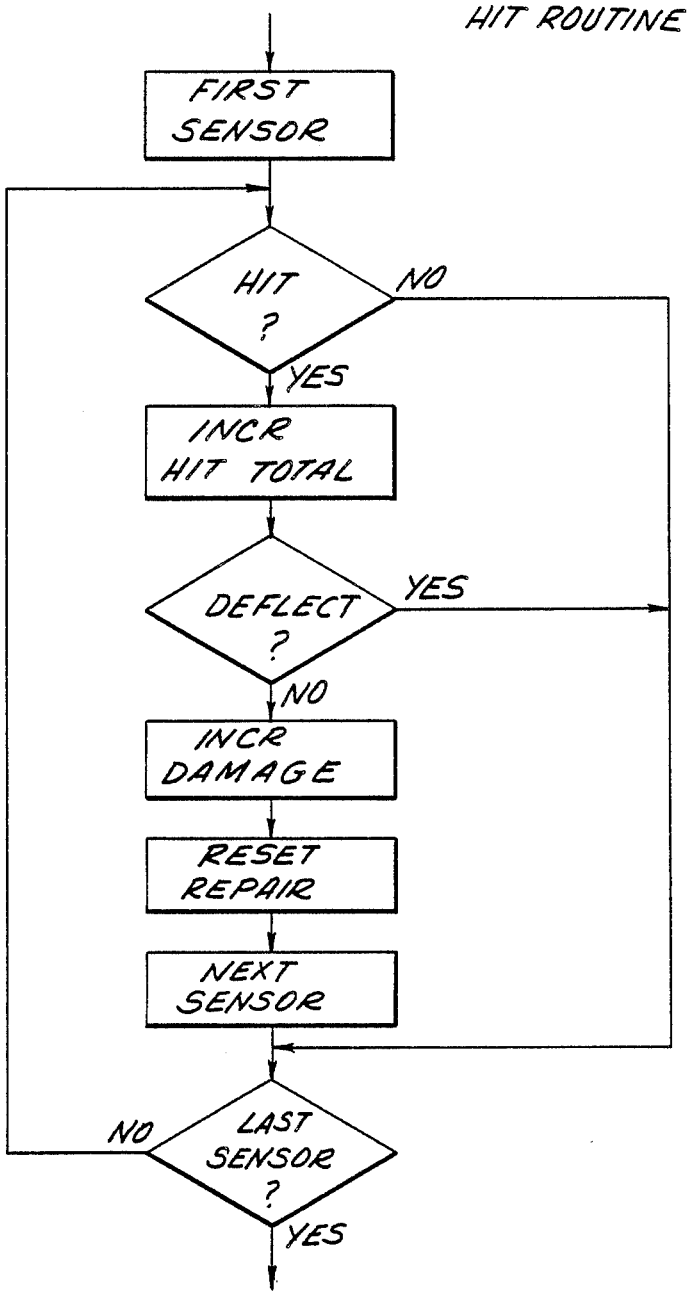
FIG. 10C is a flow chart for the "hit" routine for the microprocessor incorporated in the circuit of FIG. 9.
Figure 10D:
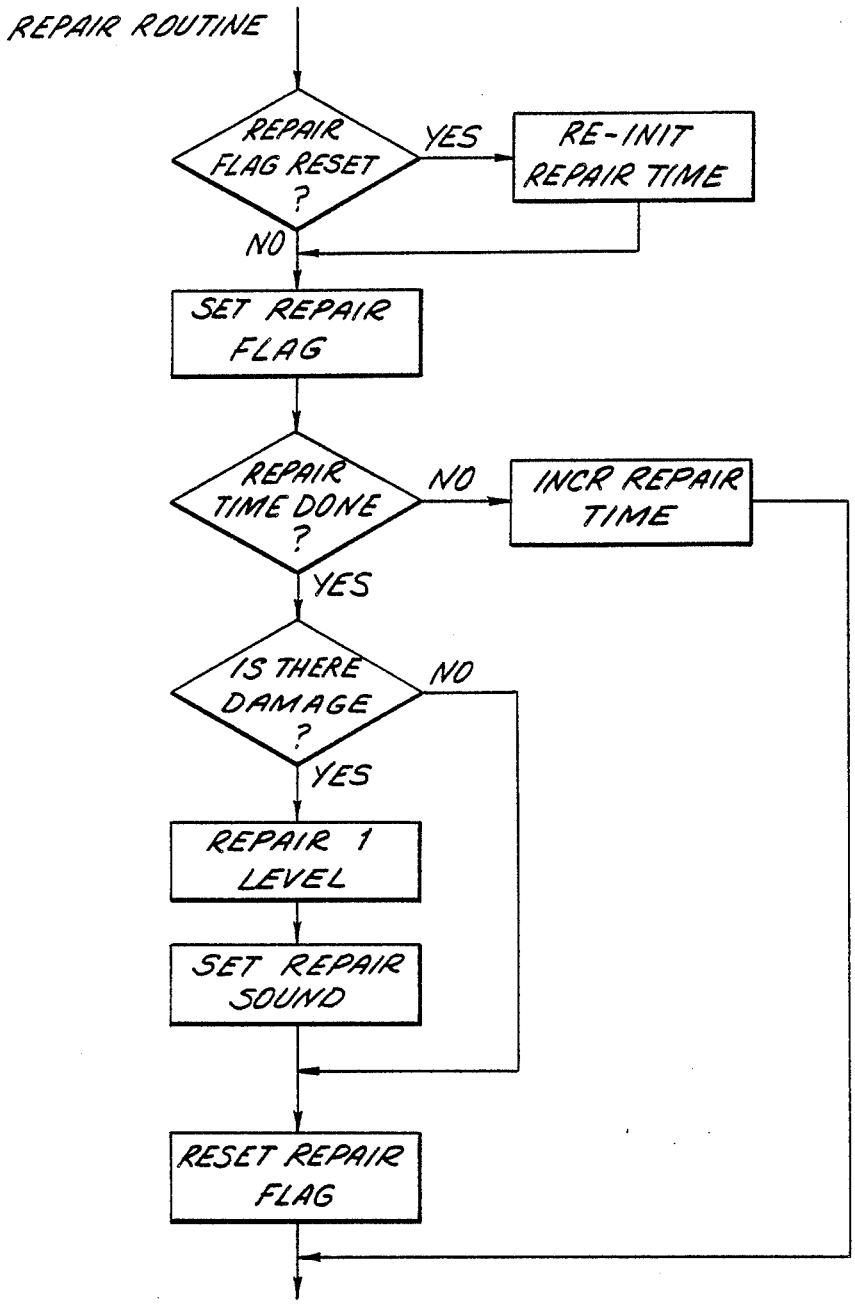
FIG. 10D is a flow chart for the "repair" routine for the microprocessor incorporated in the circuit of FIG. 9.

Referring to FIGS. 7–9, and initially to FIG. 7, the tank 12 comprises a housing 100 simulating the appearance of a combat tank. As shown, the tank 16 has a gun barrel 102 protruding from one end of a turret 104 and a pair of treads 106, 108 each of which rotates about a plurality of wheels 110, 111 respectively. As will be more fully described below, one wheel in each wheel group 110, 111 is driven by a motor for rotating the treads 106, 108.

An infrared LED 112 is disposed in the distal end of the gun barrel 102. As will be more fully explained below, in response to a fire command signal from the controller 12, the LED 112 emits an infrared beam in a substantially straight line path coaxial with the gu barrel 102. Because infrared light is invisible to the human eye, a conventional low voltage bulb 114 is disposed behind the LED 112 in the barrel 102, the bulb 114 lighting each time the LED 112 is activated. Like the LED 112, the bulb 114, shown in phantom in FIG. 7, is connected to circuitry in the housing 100 via wires (not shown) extending through the gun barrel 102.

A sensor panel 116 disposed, for example, on the front of the turret 104 detects the impingement thereon of infrared beams fired by other toy tanks. As will be more fully explained below, each time the sensor panel 116 is struck by an infrared beam from another vehicle, the sensor panel generates a signal which is utilized by a microprocessor incorporated in the tank 16 to adversely affect some operation of the tank for simulating damage thereto. If desired, additional sensor panels 116 may be disposed at other locations about the tank 16 for providing a multiplicity of targets for enemy tanks. Also shown in FIG. 7 is a translucent dome 118 and a low voltage bulb 120 (shown in phantom in FIG. 7) disposed therein. As will be more fully explained below, the bulb 120 lights whenever the shield for the vehicle 16 is activated, thereby providing a visual indication thereof to the players. The bulb 120 is connected to the circuitry within the housing 100 by wires (not shown) running through the dome support 122.

A two position switch 124 o the housing 100 allows the operator of the controller 12 to match the receiving frequency of the tank 16 with the transmission frequency of the controller 12 in a manner to be more fully explained below. Also shown on the housing 100 are a two position skill select switch 125 and a four position vehicle ID select switch 127. The function of the skill select switch 125 will be more fully explained below. The vehicle ID select switch 127 is used for correlating each of the tanks 16, 18, 20 and 22 operated by the controller 12 with one of the vehicle ID codes as selected by depression of one of the vehicle ID buttons 42, 44, 46 or 48 on the controller. For example, if position "1" of switch 127 corresponds to the vehicle ID code generated by depression of the pushbutton 42, i.e. "00", and assuming the vehicle ID select switch 127 for the tank !6 is set at the first switch position, the tank 16 will respond to commands from the controller 12 only when the pushbutton 42 is the last to be depressed of the pushbuttons 42, 44, 46 and 48. It will therefore be apparent that for the controller 12 to independently operate each of the four tanks 16, 18, 20, and 22, the vehicle ID select switches 127 on the tanks 16, 18, 20 and 22 must each be set to a different one of the four switch positions such that each responds to the controller 12 only when its corresponding pushbutton 42, 44, 46 or 48 is the last one to be depressed. Also shown on the housing 100 is a POWER ON/RESET switch 129 for connecting the circuits in the housing 100 to a power source, such as 4 "C" batteries for the motor system and a 9 V battery for the electronics, and for resetting the circuits to an initial state. While the switches 124, 125, 127 and 129 are shown on top of the housing 100 for purposes of clarity, they may be situated at other locations, such as on the underside of the housing. Not shown is a removable door, preferably on the bottom of the tank, for replacing the batteries.

As shown in FIG. 7, an antenna 126 extends upward from the turret 104. As should now be apparent, the antenna 126 conducts transmissions from the controller 12 for processing by the circuitry within the housing 100. Also shown in FIG. 7 is a speaker 123 incorporated in the housing 100 for generating various sounds as will be more fully described below.

A block diagram of the circuitry for the tank 16 is illustrated in FIG. 8. As shown in FIG. 8, transmissions from the controller 12 detected by the antenna 126 are conducted to a receiver 128 operating as a superheterodyne receiver. As is well known in the art, utilization of a superheterodyne receiver permits rf amplification at a relatively low frequency, often referred to as the intermediate frequency, whereby the receiver exhibits high selectively and gain. As will be described in greater detail in connection with FIG. 9, the local oscillator for the superheterodyne receiver 128 is switchable to one of two preselected frequencies by the switch 124, each of which corresponds to one of the two rf transmission frequencies selectable at the controller 12 by the frequency select switch 64. Consequently, the receiver 128 will only "see" a signal from the controller 12 if the transmission frequency at the controller 12 and the local oscillator frequency in the receiver 128 are matched by properly setting the switches 64 and 124. It will therefore be apparent that by setting the switches 64 and 124 in the controller 12 and tanks 16, 18, 20 and 22 to one frequency and those in the controller 14 and tanks 24, 26, 28 and 30 to the other frequency, transmissions from the controller 12 will only be detected by the tanks 16, 18, 20 and 22, whereas transmissions from the controller 14 will only be detected by the tanks 24, 26, 28 and 30. As a result, simultaneous transmissions from the controllers 12 and 14 is possible.

After demodulation by the receiver 128, the data signal is shaped by a Schmitt trigger circuit 130, the output of which is applied to a microprocessor 132. As shown, the output from the vehicle ID select switch 127 is also input to the microprocessor 132 In the microprocessor, a comparison is made between the vehicle ID data bits in the transmission from the controller 12 (FIG. 5) and the vehicle ID selected for the tank 16 by the vehicle ID select switch 127. If the two match, the command signals from the controller 12 are transmitted to an additional microprocessor 134 for controlling the operation of the tank 16 in the manner described below. However, if the vehicle ID data bits in the transmission from the controller 12 do not match the vehicle ID as selected by the switch 127, the microprocessor 132 will not transmit the command signals to the microprocessor 13 with the consequence that the tank 16 will not respond to these command signals. Assuming the local oscillator frequency as selected by the switch 124 on the tank 16 matches the transmission frequency selected by the switch 64 on the controller 12 and that the most recently depressed vehicle ID pushbutton 42, 44, 46 or 48 on the controller 12 corresponds to the position of the switch 127 on the tank 16, the command signals from the controller 12 will be transmitted from the microprocessor 13 to the microprocessor 134. In the microprocessor 134, the command signals are detected and appropriate output signals given for controlling the operation of the tank 16.

check sum (FIG. 5). Table One below shows the data word chart for the six bits following the check sum.

TABLE ONE

| FORWARD | REVERSE | LEFT | RIGHT | SPEEDS | LEFT TREAD | RIGHT TREAD |
|---|---|---|---|---|---|---|
| 1 | 0 | 1 | 0 | 11 | Stop | High Forward |
| 1 | 0 | 1 | 0 | 10 | Stop | High Forward |
| 1 | 0 | 1 | 0 | 01 | Medium Reverse | Medium Forward |
| 0 | 0 | 1 | 0 | 00 | Medium Reverse | Medium Forward |
| 0 | 1 | 1 | 0 | 01 | Medium Forward | Medium Reverse |
| 0 | 1 | 1 | 0 | 10 | Stop | High Reverse |
| 0 | 1 | 1 | 0 | 11 | Stop | High Reverse |
| 1 | 0 | 0 | 1 | 11 | High Forward | Stop |
| 1 | 0 | 0 | 1 | 10 | High Forward | Stop |
| 1 | 0 | 0 | 1 | 01 | Medium Forward | Medium Reverse |
| 0 | 0 | 0 | 1 | 00 | Medium Forward | Medium Reverse |
| 0 | 1 | 0 | 1 | 01 | Medium Reverse | Medium Forward |
| 0 | 1 | 0 | 1 | 10 | High Reverse | Stop |
| 0 | 1 | 0 | 1 | 11 | High Reverse | Stop |
| 1 | 0 | 0 | 0 | 11 | High Forward | High Forward |
| 1 | 0 | 0 | 0 | 10 | Medium Forward | Medium Forward |
| 1 | 0 | 0 | 0 | 01 | Low Forward | Low Forward |
| 0 | 1 | 0 | 0 | 11 | Low Reverse | Low Reverse |
| 0 | 1 | 0 | 0 | 10 | Medium Reverse | Medium Reverse |
| 0 | 1 | 0 | 0 | 11 | High Reverse | High Reverse |
| 0 | 0 | 0 | 0 | 00 | Stop | Stop |

More particularly, after verifying the check sum, the microprocessor 134 looks at the data bits containing the command signals for forward, reverse, right turn, left turn, speed, shielding, and firing. Referring again to FIG. 5, the command signals shown there indicate that the operator of the controller 12 has directed the tank 16 to make a high speed left turn in reverse. The microprocessor 134 thereupon provides appropriate signals to the motor drive circuits 136 and 138. As shown in FIG. 8, the motor drive circuit 136 controls the speed and direction of a motor 140 whose shaft is connected to the driven wheel 110 in the wheel group for the left tread 108, and the motor drive circuit 138 controls the speed and direction of another motor 142 whose shaft is connected to the driven wheel 111 in the wheel group for the right tread 106. Each of the motors 140, 142 may be driven in forward or reverse at one of three different speeds though, as shown in Table One below, only the two faster speeds are used for turning. For a high speed left turn in reverse, the microprocessor 134 provides an output signal to the motor drive circuit 136 for stopping the left motor and an output signal to the motor drive circuit 138 for driving the right motor 142 in reverse at its highest speed. Other appropriate signals will be provided from the microprocessor 134 to the motor drive circuits 136, 138 depending upon the speed and direction of the turn commanded by the controller 12 as indicated by the status of the six data bits following the Referring back to FIG. 5, the two data bits after the speed data bits indicate, respectively, whether the tank 16 has been commanded to change its shield status and/or to fire. The shield button 60 is a one shot type trigger switch which provides a "1" data bit each time the button 60 is depressed. In response to a "1" the microprocessor changes the state or the shield, i.e. if the shield were previously activated it is now deactivated and vice versa. If the shield is activated the microprocessor 134 outputs a signal to the driver circuit I44 for powering the bulb there by providing a visual indication to the players that the shield for the vehicle 116 has been activated. Simultaneously, the microprocessor activates a counter to record the time duration during which the shield remains activated. In this regard, and as is true of all the commands given by the controller 12, the shield will remain activated until the tank 16 receives a different command coded with the proper vehicle ID code from the controller 12 or until the shield expires in a manner more fully explained below. As will also be more fully described below, as long as the shield for the vehicle 16 remains activated, the vehicle will not suffer damage from an enemy "hit". However, the shield will only remain activated for a predetermined time and, during this time, the vehicle 16 cannot fire. In the example shown in FIG. 5, the data bit for the shield is "0", so the microprocessor 134 will leave the shield as it is.

If the fire command data bit is a "1", the microprocessor 134 provides an output signal to the emitter drive circuit 146 and also to the drive circuit 148. As shown, the emitter drive circuit 146 powers the infrared LED 112 at the distal end of the gun barrel 102 with the intent of striking the sensor panel 116 on an enemy tank for inflicting damage thereto. Simultaneously, the driver circuit 148 lights the bulb 114 behind the infrared LED 112 for providing a visual indication that the tank is firing. Actually, the driver circuit 148 pulses the LED 112 and each microprocessor 134 is programmed to record a hit only if its respective sensor panel receives a pulsed infrared beam. This avoids false "hits" from ambient infrared sources.

At appropriate times, the microprocessor 132 provides output signals to a sound amplifying circuit 150 which drives the speaker 123 to simulate battle sounds. For example, each time the vehicle 16 is hit by enemy fire impacting its sensor 116, the speaker 123 generates a sound simulating an enemy shell striking metal.

As also shown in FIG. 8, the output of the infrared sensor panel 116 is input to the microprocessor 134 via an amplifier circuit 152 and a latch circuit 154. As will be more fully described below, each successsive hit by enemy fire on the sensor panel 116 results in some effect on the operation of the tank 16 in accordance with the program of the microprocessor 134. In the preferred operation of the vehicle 16, the vehicle 16 suffers increasing damage with the first five hits, and is destroyed on the sixth hit, whereupon all its functions are disabled. Preferably, and as shown in FIG. 7, the number of hits sustained by the vehicle 16 is apparent from the LED's 156 on the top of the turret 104 of the tank 16, the number of lit LED's indicating the number of hits sustained by the vehicle 16. Referring back to FIG. 8, the LED's 156 are driven by the microprocessor 134 which counts the number of hits sustained by the sensor panel 116 as transmitted via the latch circuit 154 and then lights the LED's 156 accordingly.

FIG. 9 shows a preferred circuit implimentation for the circuits illustrated in block diagram form in FIG. 8. As in the case of FIG. 4, the dotted lines in FIG. 9 delineate the circuit blocks of FIG. 8, again with the caveat that particular circuit components could as easily be included in one circuit block as another. While the circuit of FIG. 9 is preferred, persons of ordinary skill in the art who have read this description will recognize that various modifications and changes may be made therein.

In FIG. 9, it will be seen that the output from the antenna 126 is input to the superheterodyne receiver 128 comprising a mixer, intermediate frequency amplifiers and a detector. The local oscillator circuit for the receiver 128 is designated at 158. As shown, the local oscillator circuit 158 incorporates two oscillators X1 and X2, each of which oscillates at a different frequency. The oscillation frequency of the circuit 158 is selected by the position of the switch 124 on the vehicle 16. As shown, the switch 124 is incorporated in the circuit 158.

Assuming the transmission frequency from the controller 12 matches the oscillation frequency selected at the switch 124, the receiver 128 demodulates the incoming data burst from the controller. The data signal is then output from the receiver 128 to a Schmitt trigger circuit 130 which, as noted previously, shapes the data signal and inputs same to the microprocessor 132. As noted, the microprocessor 132 compares the vehicle ID data bits with the vehicle ID code as selected by the switch 127 and, if there is a match, transmits the data command signals to the microprocessor 134. The circuit designated at 160 generates clock pulses for the microprocessors 132 and 134.

As previously indicated, the microprocessor 134 detects the command signals in the data from the controller 12 and provides appropriate control signals to the motor drive circuits 136 and 138 for controlling movement of the vehicles 16, to the drive circuit 146 for controlling "firing" of the infrared LED 112, to the sound amplification circuit 150 for controlling sounds generated by the speaker 123, to the driver circuit 144 for the bulb 120 for lighting the bulb 120 when the vehicle shield is activated, and to the driver circuit 148 for the bulb 114 for lighting the bulb 114 each time the infrared LED 112 is fired. As also described above, the microprocessor 134 also receives as an input via the amplifier circuit 152 and latch circuit 154 the output from the infrared sensor panel 116 for counting the number of hits by enemy vehicles and for displaying the number of hits by lighting the appropriate number of LEDs 156.

Not shown in FIG. 9 is the POWER ON/RESET circuitry for the tank circuit. Such circuitry is conventional and may, for example, take the form shown in FIG. 4 for the controller 12. A parts list for the circuit illustrated in FIG. 9 appear below.

PARTS LIST (FIG. 10)

| | | | | | |
|---|---|---|---|---|---|
| R1 | 10K | R50 | 15K | T1 | CECKH801 |
| R2 | 1.5K | R51 | 10K | T2 | CECAH932 |
| R3 | 330 | R52 | 1 | T3 | CECAH931 |
| R4 | 150K | R53 | 1 | T4 | CECAH933 |
| R5 | 39K | R54 | 1 | T5 | audio; to 8 ohms |
| R6 | 330 | C1 | 10pf | Q1 | 25C1417E |
| R7 | 33K | C2 | 20pf | Q2 | 25C1417E |
| R8 | 330 | C3 | 1uf | Q3 | 25C13901 |
| R9 | 100K | C4 | 3pf | Q4 | 25C13901 |
| R10 | 220 | C5 | .01uf | Q5 | 25C139O1 |
| R11 | 100K | C6 | .02uf | Q6 | 9014 |
| R12 | 15K | C7 | .02uf | Q7 | 9014 |
| R13 | 1.5K | C8 | 15pf | Q8 | 9013 |
| R14 | 1K | C9 | .05uf | Q9 | 9013 |
| R15 | 33K | C10 | 2Opf | Q1O | JE9013 |
| R16 | 10K | C11 | .02uf | Q11 | 2N6427 |
| R17 | 270 | C12 | 1uf | Q12 | 2SB733 |
| R18 | 5.6K | C13 | 4.7uf | Q13 | 2SB733 |
| R19 | 10K | C14 | .01uf | Q14 | 9014 |
| R20 | 1K | C15 | .02uf | Q15 | 9014 |
| R21 | 100 | C16 | 1uf | Q16 | 2SD733 |
| R22 | 100 | C17 | .02uf | Q17 | 2SD773 |
| R23 | 330 | C18 | 2.2uf | Q18 | 2SB733 |
| R24 | 470 | C19 | .005uf | Q19 | 2SB733 |
| R25 | 1M | C20 | 47uf | Q20 | 9014 |
| R26 | 4.7K | C21 | 47uf | Q21 | 9014 |
| R27 | 100K | C22 | .1uf | Q22 | 2SD773 |
| R28 | 4.7K | C23 | 220pf | Q23 | 2SD773 |
| R29 | 4.7K | C24 | 220pf | Q24 | 9013 |
| R30 | 4.7K | C25 | .1uf | Q25 | 9013 |
| R31 | 4.7K | C26 | .047uf | X1 | 27045kHz |
| R32 | 10K | C27 | 220uf | X2 | 27095kHz |
| R33 | 10K | C28 | 10uf | X3 | 495kHz |
| R34 | 1K | C29 | .01uf | L1 | 3.8uh |
| R35 | 1K | C30 | 1000pf | L2 | 200mh |
| R36 | 1K | C31 | 47uf | L3 | 10uh |
| R37 | 1K | C32 | 1uf | L4 | 10uh |
| R38 | 1K | C33 | 1uf | L5 | 10uh |
| R39 | 100 | C34 | 1uf | L6 | 10uh |
| R40 | 100 | C35 | 1uf | LB1 | 5VDC |
| R41 | 20K | C36 | 1uf | LB2 | 5VDC |
| R42 | 390K | C37 | 1uf | IC1 | COP445 |
| R43 | 100K | C38 | 1uf | IC2 | COP413 |
| R44 | 4.7K | C39 | 1uf | A1-A6 | IC4069 |
| R45 | 100K | C40 | 47uf | | |
| R46 | 10M | C41 | 470uf | | |

-continued

| PARTS LIST (FIG. 10) | | | | | |
|---|---|---|---|---|---|
| R47 | 10K | C42 | 5000pf | D1-D8 | IN4148 |
| R48 | 33K | IRE | NEC303A | Z1 | 5V1 |
| R49 | 330 | IRR | 3 NECPH302 | Z2 | 5V6 |

As indicated, the manner in which the microprocessors 132 and 134 control the operation of the vehicle 16 is determined by the programs for the microprocessors. Flowcharts for various functions performed by the microprocessor are illustrated in FIG. 10.

A brief overview of the operation of the multi-vehicle interactive toy system in accordance with the present invention will now be described, although by now most of the operational details of the system will be apparent to the those of ordinary skill in the art. In the following description it will be assumed, in accordance with FIG. 1, that each of the controllers 12, 14 is commandeering four tanks.

Initially, the controllers 12 and 14 are activated by throwing the switches 62 to the ON position. Similarly, the tanks 16, 18, 20, 22, 24, 26, 28 and 30 are activated by throwing their respective switches 129 to the ON position. The players then decide which tanks will operate at which frequency whereupon the frequency select switch on the controller 12 is moved to one position and the frequency select switch on the controller 14 is moved to the other. The frequency select switches 124 on the tanks 16, 18, 20 and 22 are then moved to the position corresponding to the position of the switch 64 in the controller 12 and the frequency select switches 124 in the tanks 24, 26, 28 and 30 are moved to the other position corresponding to the position of the switch 64 in the controller 14. The system is now set such that the tanks 16, 18, 20 and 22 will respond only to commands from the controller 12, and the tanks 24, 26, 28 and 30 will only respond to commands from the controller 14. Furthermore, because the controllers 12, 14 and their respective tanks are operating at different frequencies, both controllers can simultaneously transmit command signals to their respective tanks without interference.

In final preparation for battle, each player sets each vehicle ID switch 127 in his respective four tanks to a different one of the four positions such that each tank will only respond to its respective controller when the appropriate vehicle ID button has been depressed. For example, with respect to the controller 12 and tanks 16, 18, 20 and 22, the switch 127 in the tank 16 may be set at the first position for responding to the controller 12 when the pushbutton 42 is depressed, the switch 127 in the tank 18 may be set at the second position for responding to the controller 12 only when the pushbutton 44 has been depressed, etc. The battle is now ready to begin.

Each player now selects the vehicle he will first command by depressing the appropriate pushbutton switch 42, 44, 46 or 48. Upon depression of the switch, the LED 50, 52, 54 or 56 associated therewith lights up, thereby providing the player with a visual indication of the particular vehicle then under his control. The player may then move the vehicle in a plurality of directions as more fully described above by appropriate manipulation of the joystick 38, command the vehicle to fire an infrared beam via LED 112 at enemy sensor panels 116 by depressing the button 58, and/or direct the vehicle to activate/deactivate its deflector shield by depressing one of the buttons 60.

When the pushbutton 58 is depressed for commanding the vehicle then under the player's control to fire, the tank emits a pulsed infrared beam via the LED 112 for ½ second, lights the bulb 114 behind the LED 112 for ½ second for providing a visual indication that the LED 112 has fired, and also commands the sound amplifier 150 to generate a fire sound via speaker 123 for ½ second for providing audible confirmation that firing has occurred and for adding to the realism of the simulated battle. Until firing is completed, the microprocessor 134 rejects new commands, i.e. the microprocessor continues to operate the vehicle in accordance with the group of commands that accompanied the fire command. For example, if the fire command was accompanied by data bits directing the vehicle to turn slowly to the left, the vehicle will continue to turn slowly to the left until firing is completed despite new positioning of the joystick 38 by the player. After firing, the microprocessor 134 counts two seconds before again activating the drive circuit 14 for the LED 112. That is, the tank will not accept a new firing command signal from the controller 12 for two full seconds thereby simulating a reloading time for the tank.

Regardless of which vehicle is being controlled by its respective controller, all vehicles are susceptible to hits from enemy vehicles via their respective sensor panels 116. Preferably, each tank is fitted with three sensor panels 116 connected by fiber optic piping, one sensor on the front of the turrett and one on either side of the turrett. The effect of successive hits on a particular vehicle is controlled by the microprocessor 134, i.e. without player input. The following is a description of the impact of each of six successive hits on a particular vehicle. In the following it is assumed that the vehicle has not effected a repair between hits, as more fully described below. After the first hit, and assuming the tank is in motion, both motors 140, 142 stop for ½ second. If the tank is not in motion at the time of the hit, both motors move in reverse for ¼ second. This simulates a hit. Simultaneously, microprocessor 134 provides an output signal to the amplifier 150 for generating a hit sound over the speaker 123 for one full second. At the same time, the microprocessor provides an output signal to the first LED 156 which then remains lit. Preferably, the first LED is yellow.

In response to the second hit, the motors 140, 142 again stop the tank for ½ second if it is in motion, or operate in reverse for ¼ second if the tank is stationary at the time of the hit. Again, a hit sound sounds over the loudspeaker 123 for one full second, and a second LED 156, also preferably yellow, lights up. Like the first LED, the second LED remains on, indicating that the tank has received two hits. With the third hit, the motors 140, 142 again stop for ½ second if the tank is in motion, and operate in reverse for ¼ second if the tank is stationary. A hit sound is again generated over the loundspeaker 123 for one full second. Simultaneously, the microprocessor 134 lights up a third, preferably red LED 156, which remains on along with the two yellow LED's for indicating that the tank has sustained a third hit. In addition, the microprocessor now blocks transmission of firing signals to the drive circuit 146 for four seconds instead of two second between firings, simulating a lengthening of the required reloading time. This deterioration in reloading time remains effective until the tank is reset or until the third hit is repaired, as will be more fully explained below. After the fourth hit, the motors 140, 142 again stop for ½ second if the tank is in motion and operate in reverse for ½ second if it is not. Simultaneously, a hit sound is generated over the loudspeaker 123 for one second and a fourth, also preferably red LED lights up. In addition, the microprocessor 134 now operates one of the motors 140, 142 at ¾ of its indicated speed, e.g. if the joystick 38 is at a full speed setting for the motor, the motor operates at only ¾ of Again, the extended reloading time and reduced motor speed remain in effect and the four LED's stay on until the tank is either reset or repaired.

With the fifth hit, the motors 140, 142 again stop for ½ second if the tank is in motion, and operate in reverse for ¼ second if the tank is stationary. Also, the microprocessor 134 provides a signal to the sound amplifier 150 for generating a one second hit sound over the speaker 123. Simultaneously, the microprocessor 134 generates an output signal for lighting the fifth LED, which is also preferably red. In addition to the damage inflicted by the third and fourth hits which, as noted above, is cumulative, after the fifth hit the motors 140, 142 start and stop every ¼ second whenever the tank is in motion, simulating motor "cough". So, after the fifth hit, the reloading time is four seconds, one motor is operating at ¾ of full speed, the motors start and stop every ¼ second, and the five LED's 156 remain lit. These conditions prevail until the vehicle is reset, repaired or destroyed.

With the sixth hit the microprocessor 134 drives the motors 140, 142 to have the vehicle make a wide turn and then stop. A control signal is provided to the sound amplifier 150 for generating an explosion sound over the speaker 123 for four seconds. The vehicle will then not accept any command signals from the controller 12 for approximately 12 seconds, indicating that the vehicle has been destroyed. Thereafter, the vehicle will reset automatically as indicated by an audible beep over the speaker 123.

When a tank receives a shield signal from the controller 12, i.e. a "1" data bit, the shield will be activated if it is off, and deactivated if it is on. When the shield is activated, the microprocessor 134 provides an output signal to the drive circuit 144 for lighting the bulb 120 for providing a visual indication that the shield has been activated. As long as the shield remains activated, enemy hits are considered deflected, with the consequence that the LED's 156 do not light and no permanent damage is inflicted. However, if a vehicle with its shield activated is hit by enemy fire, the motors 140, 142 will stop for ½ second if the tank is in motion and operate in reverse for ¼ second if it is not. A "deflect" sound, which is different from the "hit" sound, will be generated over the speaker 123 for one second.

Once the shield is on, it can be turned off in one of two ways, either by a new command signal from the controller or automatically after a predetermined period of time. More particularly, in the microprocessor 134, a register is set at 15 each time the tank is reset. When the shield is activated, the register decrements by one for every second the shield remains on and increments by one for every second when the shield is off. The register, however, cannot count higher than 15 or lower than 0. In addition to decrementing by one for every second that the shield is activated, the shield decrements by three after each deflected hit, so the shield will continue to deflect hits only as long as the number in the register is greater than two. As noted previously, as long as the register is decrementing, i.e. as long as the shield is activated, the tank is not able to fire at enemy tanks, i.e. the microprocessor 134 will not provide a control signal to the drive circuit 146 for the infrared LED 112. Decrementing the shield whenever it is activated simulates the utilization of energy required to keep the shield functioning. Likewise, decrementing the shield by three in response to a hit reflects that greater energy usage is required to repel the hit.

If, after receiving one or more enemy hits, a tank neither fires nor receives a non-deflected hit for fifteen seconds, the microprocessor 134 will automatically "repair" the damage from the previous hit. For example, if the previous hit was the fourth hit and the vehicle does not fire nor sustain a non-deflected hit for fifteen seconds following the fourth hit, the slowed motor will return to full speed and the fourth LED will go out. If, thereafter, the vehicle again does not fire nor receive a non-deflected hit for an additional fifteen second interval, the microprocessor 134 will "repair" the damage from the third hit, and so on. Permitting the tank to repair only if the tank has not fired or been hit simulates that repaires can only be effected when the tank crew is not otherwise occupied.

Flowcharts for the microprocessor 134 for the fire, shield, hit and repair routines is in FIGS. 10A, 10B, 10C and 10D, respectively.

As previously noted, when a tank receives a command burst from its respective controller, it will remain in the state dictated by that command burst until the next command burst is received. For example, if the last command burst to a tank directs the tank to make a sharp, fast turn to the left and to fire, that tank will continue to turn sharply to the left and fire every two seconds (assuming reloading time has not been extended) until the next command burst for that tank is received.

As indicated in FIGS. 8 and 9, the skill select switch 125 is applied directly to an input of the microprocessor 134, the switch 125 presenting an open circuit condition to the microprocessor when the skill switch is off and a ground condition to the microprocessor when the switch is on. When the skill select switch is on, combat is made more difficult by increasing the normal reloading time from two seconds to approximately three seconds, and by further increasing the reloading time to approximately five seconds after the vehicle sustains its third hit.

As will now be apparent, the multi-vehicle interactive toy system in accordance with the present invention will continuously test the dexterity and strategy of the participants who can manipulate their respective tanks, via controllers 12 and 14, into an endless variety of battle situations. Moreover, the firing, reloading, repair and shield times are selected such that a player cannot sit back and avoid damage or effect repair by simply leaving his shield on, thereby adding to the strategy required if the player is to win.

While the operation of the tanks as described above is a preferred embodiment, it will be apparent once this description is known that various changes and modifications may be made therein.

For example, each controller may operate in conjunction with a small building simulating headquarters. As presently contemplated the headquarters would not have the ability to fire or move, but would have a sensor panel for receiving hits. After a predetermined number of hits, the headquarters would be "destroyed" whereupon all the tanks commanded by the respective controller would be disabled, making the other player the winner. Establishing communication between a particular controller and a particular headquarters structure could be accomplished by switches on the bottoms of the headquarters structures and corresponding switches on the controllers. A principal advantage of this modification is that it ties all the tanks together in a master game plan requiring coordination for protecting headquarters. If desired, more than two headquarters could be included permitting almost limitless variation and sophistication. And while as presently contemplated the headquarters structure is not movable, it could be fitted with appropriate motors, wheels, etc. to effect movement if desired. The details for the construction of a headquarters will be readily apparent to those of ordinary skill in the art once this description is known.

In one modification, the shield counter decrements 1 count every 5 seconds, but increments 1 count every second. The effect, of course, is to allow the shield to be activated for a longer time period, while still "recharging" the shield at a fairly rapid rate. If this modification is employed, the up-counter for repairs may be preset to zero after both deflected and non-deflected hits thereby preventing a player from effecting repairs by leaving the shield up and remaining stationary, i.e. evasive action will also be necessary. It is anticipated that these modifications will result in even more intensive strategy of attacking and retreating, resulting in longer play and hence greater enjoyment.

If additional controllers operating at frequencies that differ from those of the controllers 12 and 14 are added, the number of players can be expanded beyond two. For example, by adding two more controllers, each of which is selectively operable at third and fourth frequencies, a third player can operate a battalion of four tanks by setting his controller to the third frequency and a fourth player can operate yet an additional battalion of four tanks by setting his controller to the fourth frequency. The play benefits of this modification will be self-apparent.

As a still further modification, each tank may be fitted with a plurality of sensors which, upon being hit, result in different types of damage to the tank. For example, a tank could have a sensor located near each tread, with a hit resulting in some type of damage to the corresponding tread. Similarly, sensors disposed near the engine, gun barrel, etc., could respond to hits by adversely affecting movement and firing, respectively. As a still further modification, reflectors may be disposed about the battle field for reflecting infrared beams fired by the tanks. Also, the microprocessor 134 may be programmed to randomly permit hits to register even when the vehicle shield is activated. This simulates an imperfect shield, i.e. a shield that is not always effective even though activated thereby adding further realism to the game. If desired, the bulb 114 may be fitted with a focusing reflector for generating a straight line visible light path substantially coincident with the infrared light path of the LED 112 for providing the players with a visible indication of where they are aiming.

Since these as well as further changes and modifications may be made wihtout departing from the spirit and scope of the invention, the following detailed description should be construed as illustrative and not in a limiting sense, the scope of the invention being defined by the following claims.

I claim:

1. An interactive multi-vehicle combat game comprising:

first and second controllers, each including means operable by a player for selectively generating a control signal including at least a fire command signal and a movement command signal;

means for transmitting said control signal;

first and second vehicles controlled by said first and second controllers, respectively, each vehicle including:

detecting means for receiving said control signal, firing means responsive to said fire command signal for transmitting an electromagnetic signal in a substantially straight line path when the fire command signal is in said control signal received by said detecting means, motive means for moving said vehicle when said movement command signal is in said control signal received by said detector means, sensor means for detecting impingement of an electromagnetic signal fired by another vehicle and for generating a damage signal in response thereto, and indicator means responsive to said damage signal for providing an indication that said sensor means has detected an electromagnetic signal fired by said other vehicle.

2. The game according to claim 1, wherein said indicator means further comprises means for impairing the function of at least one of said motive means and said firing means for simulating damage to said vehicle.

3. The game according to claim 2, wherein said indicator means further comprises means for progressively impairing the function of said at least one of said motive means and said firing means as the number of electromagnetic signals detected by said sensor means increases.

4. The game according to claim 3, further comprising means for progressively restoring said impaired function in the absence of said indicator means providing said indication for predetermined time periods.

5. The game according to claim 2, further comprising means for restoring said impaired function in the absence of said indicator means providing said indication for a predetermined time period

6. The game according to claim 1, wherein each controller further comprises means operable by a player for selectively generating a shield signal as part of said control signal, and wherein each vehicle comprises means effective for a finite time duration for inhibiting said indicator means when said shield signal is in said control signal received by said detecting means.

7. The game according to claim 6, wherein said inhibiting means further comprises means for reducing said time duration in response to said damage signal.

8. The game according to claim 6, further comprising means for disabling said firing means when said inhibiting means is effective.

9. The game according to claim 6, wherein each vehicle further comprises means for unpredictably restoring said indicator means for simulating an imperfect shield.

10. The game according to claim 6, wherein said indicator means is alternatively inhibited and restored when said shield signal is in said control signal.

11. The game according to claim 1, wherein said electromagnetic signal is an infrared signal.

12. The game according to claim 11, wherein each vehicle comprises means for indicating transmission of said infrared signal.

13. The game according the claim 1, wherein said means in said controller for conveying said control signal comprises means for wireless transmission of said control signal.

14. The game according to claim 13, wherein said wireless transmission means comprises means for modulating an rf signal with said control signal; wherein said detecting means comprises means for demodulating said rf signal; wherein each controller further comprises means operable by a player for selecting one of a plurality of different rf frequencies for modulation by said control signal; and wherein each vehicle further comprises means for selectively demodulating one of said plurality of rf frequencies whereby each controller and the vehicle controlled thereby may be operated at a different one of said plurality of rf frequencies for accommodating simultaneous wirelesss transmission from said controllers to their respective vehicles without interference.

15. The game according to claim 1, further comprising at least a third vehicle controlled by said first controller and a fourth vehicle controlled by said second controller; wherein each controller further comprises means operable by a player for selectively generating, as part of said control signal, a vehicle ID signal corresponding to one of the vehicles controlled thereby; wherein each vehicle further comprises means operable by a player for selectively generating a vehicle ID signal corresponding to at least one of the vehicle ID signals generated by said controller; and wherein each vehicle responds to said command signals only if the vehicle ID signal in said control signal matches the vehicle ID signal generated by said vehicle.

16. The game according to claim 15, wherein each vehicle continues to respond to the command signals from the last control signal incorporating its respective vehicle ID signal.

17. An interactive multi-vehicle combat game comprising:

first and second controllers, each including means operable by a player for selectively generating a control signal including at least a fire command signal and a movement command signal;

means for transmitting said control signal;

first and second vehicles controlled by said first and second controllers, respectively, each vehicle including:

detecting means for receiving said control signal, firing means responsive to said fire command signal for transmitting an electromagnetic signal in a substantially straight line path when the fire command signal is in said control signal received by said detecting means, motive means for moving said vehicle when said movement command signal is in said control signal received by said detector means, sensor means for detecting impingement of an electromagnetic signal fired by another vehicle and for generating a damage signal in response thereto, and indicator means responsive to said damage signal for providing an indication that said sensor means has detected an electromagnetic signal fired by said other vehicle, said indicator means including means for progressively impairing the function of at least one of said motive means and said firing means as the number of electromagnetic signals detected by said sensor means increases.

18. The game according to claim 17, further comprising means for progressively restoring said impaired function in the absence of said indicator means providing said indication for a predetermined time period.

19. The game according to claim 17, wherein each controller further comprises means operable by a player for selectively generating a shield signal as part of said control signal, and wherein each vehicle comprises means effective for a finite time duration for inhibiting said indicator means when said shield signal is in said control signal received by said detecting means.

20. The game according to claim 19, wherein said inhibiting means further comprises means for reducing said time duration in response to said damage signal.

21. The game according to claim 19, further comprising means for disabling said firing means when said inhibiting means is effective.

22. The game according to claim 19, wherein each vehicle further comprises means for unpredictably restoring said indicator means for simulating an imperfect shield.

23. The game according to claim 19, wherein said indicator means is alternately inhibited and restored when said shield signal is in said control signal.

24. The game according to claim 17, wherein said electromagnetic signal is an infrared signal.

25. The game according to claim 24, wherein each vehicle comprises means for indicating transmission of said infrared signal.

26. The game according to claim 17, wherein said means in said controller for conveying said control signal comprises means for wireless transmission of said control signal.

27. The game according to claim 26, wherein said wireless transmission means comprises means for modulating an rf signal with said control signal; wherein said detecting means comprises means for demodulating said rf signal; wherein each controller further comprises means operable by a player for selecting one of a plurality of different rf frequencies for modulation by said control signals; and wherein each vehicle further comprises means for selectively demodulating one of said plurality of rf frequencies whereby each controller and the vehicle controlled thereby may be operated at a different one of said plurality of rf frequencies for accommodating simultaneous wireless transmission from said controllers to their respective vehicles without interference.

28. The game according to claim 17, further comprising at least a third vehicle controlled by said first controller and a fourth vehicle controlled by said second controller; wherein each controller further comprises means operable by a player for selectively generating, as part of said control signal, a vehicle ID signal corresponding to one of the vehicles controlled thereby; wherein each vehicle further comprises means operable by a player for selectively generating a vehicle ID signal corresponding to at least one of the vehicle ID signals generating by said controller; and wherein each vehicle responds to said command signals only if the vehicle ID signal in said control signal matches the vehicle ID signal generated by said vehicle.

29. The game according to claim 28, wherein each vehicle continues to respond to the command signals from the last control signal incorporating its respective vehicle ID signal.

30. An interactive multi-vehicle combat game comprising:

first and second controllers, each including means operable by a player for selectively generating a control signal including at least a fire command signal, a movement command signal, and a shield signal;

means for transmitting said control signal;

first and second vehicles controlled by said first and second controllers, respectively, each vehicle including:

detecting means for receiving said control signal, firing means responsive to said fire command signal for transmitting an electromagnetic signal in a substantially straight line path when the fire command signal is in said control signal received by said detecting means, motive means for moving said vehicle when said movement command signal is in said control signal received by said detector means, sensor means for detecting impingement of an electromagnetic signal fired by another vehicle and for generating a damage signal in response thereto, indicator means responsive to said damage signal for providing an indication that said sensor means has detected an electromagnetic signal fired by said other vehicle, and means effective for a finite time duration for inhibiting said indicator means when said shield signal is in said control signal received by said detecting means.

31. The game according to claim 30, wherein said indicator means further comprises means for impairing the function of at least one of said motive means and said firing means for simulating damage to said vehicle.

32. The game according to claim 31, further comprising means for progressively restoring said impaired function in the absence of said indicator means providing said indication for a predetermined time period.

33. The game according to claim 30, wherein said indicator means further comprises means for progressively impairing the function of said at least one of said motive means and said firing means as the number of electromagnetic signals detected by said sensor means increases.

34. The game according to claim 33, further comprising means for progressively restoring said impaired function in the absence of said indicator means providing said indication for a predetermined time period.

35. The game according to claim 30, wherein said inhibiting means further comprises means for reducing said time duration in response to said damage signal.

36. The game according to claim 30, further comprising means for disabling said firing means when said inhibiting means is effective.

37. The game according to claim 30, wherein said electromagnetic signal is an infrared signal.

38. The game according to claim 37, wherein each vehicle comprises means for indicating transmission of said infrared signal.

39. The game according to claim 30, wherein said means in said controller for conveying said control signal comprises means for wireless transmission of said control signal.

40. The game according to claim 39, wherein said wireless transmission means comprises means for modulating an rf signal with said control signal; wherein said detecting means comprises means for demodulating said rf signal; wherein each controller further comprises means operable by a player for selecting one of a plurality of different rf frequencies for modulation by said control signals; and wherein each vehicle further comprises means for selectively demodulating one of said plurality of rf frequencies whereby each controller and the vehicle controlled thereby may be operated at a different one of said plurality of rf frequencies for accommodating simultaneous wireless transmission from said controllers to their respective vehicles without interference.

41. The game according to claim 30, further comprising at least a third vehicle controlled by said first controller and a fourth vehicle controlled by said second controller; wherein each controller further comprises means operable by a player for selectively generating, as part of said control signal, a vehicle ID signal corresponding to one of the vehicles controlled thereby; wherein each vehicle further comprises means operable by a player for selectively generating a vehicle ID signal corresponding to at least one of the vehicle ID signals generating by said controller; and wherein each vehicle responds to said command signals only if the vehicle ID signal in said control signal matches the vehicle ID signal generated by said vehicle.

42. The game according to claim 41, wherein each vehicle continues to respond to the command signals from the last control signal incorporating its respective vehicle ID signal.

43. The game according to claim 30, wherein each vehicle further comprises means for unpredictably restoring said indicator means for simulating an imperfect shield.

44. The game according to claim 30, wherein said indicator means is alternately inhibited and restored when said shield signal is in said control signal.

* * * * *